United States Patent [19]

Ganzmann et al.

[11] Patent Number: 4,760,657

[45] Date of Patent: Aug. 2, 1988

[54] SNOW SWEEPING METHOD AND APPARATUS

[75] Inventors: Herbert Ganzmann; Gunther Pastari, both of Hausern, Fed. Rep. of Germany

[73] Assignee: Ing. Alfred Schmidt GmbH, Blasien, Fed. Rep. of Germany

[21] Appl. No.: 890,407

[22] Filed: Jul. 28, 1986

[30] Foreign Application Priority Data

Jul. 26, 1985 [DE] Fed. Rep. of Germany ..... 3526883

[51] Int. Cl.[4] ..... E01H 5/04

[52] U.S. Cl. ..... 37/232; 15/82; 37/245; 172/2; 172/430; 172/785

[58] Field of Search ..... 37/232, 245, 262, 253, 37/238; 15/82, 83; 172/784, 785, 2, 430, 3, 7

[56] References Cited

U.S. PATENT DOCUMENTS 2,198,407 4/1940 DeBrun ..... 37/253
3,113,332 12/1963 Kasper ..... 15/82
3,616,477 11/1971 Larson ..... 15/82

*Primary Examiner*—Edgar S. Burr
*Assistant Examiner*—Moshe I. Cohen
*Attorney, Agent, or Firm*—George E. Kersey

[57] ABSTRACT

A snow-sweeping roller for replaceable attachment to a utility road vehicle (1) having brush-equipped roller (4) rotatably affixed at the underside of the vehicle. To achieve low-wear operation of the sweeper roller (4) and simultaneously low energy consumption, a control device is provided for adjusting and changing roller rpm in accordance with the following factors:

(a) The circumferential speed (w) of the roller changes in proportion to vehicle speed (f);

(b) The circumferential speed (w) of the roller has a ratio to the vehicle speed (f) that ranges from unity to two; and (c) A minimum value of the circumferential speed (w-min) of the roller is established for when the vehicle is moving slowly or is stationary.

19 Claims, 4 Drawing Sheets

1
2
3
4
5
6
7
8
10
11
12
13
14
15
16
17
18
19
20
21
22
23
24
26
P1
P2

SPEED REGULATION CHARACTERISTICS

SNOW SWEEPING METHOD AND APPARATUS

BACKGROUND OF THE INVENTION

This invention relates to a snow-sweeping roller, such as a bristle-equipped sweeping roller, for replaceable attachment to a utility road vehicle. The roller is rotatably hung on the vehicle about a horizontal longitudinal axis, which can be set at a slant with respect to the longitudinal axis of the vehicle. The roller rotation can be counter to the wheels of the forwardly moving vehicle.

Snow-sweeping rollers are well known. They are used for the so-called "black clearance" of snowy streets in which snow is removed to the surface of any underlying asphalt. Tests have shown that the combined use of a roller with a snow plow and/or salt spreading device is especially advantageous. In particular, rollers make it possible to reduce considerably the amount of salt that is spread. The use of a snow-sweeping roller, however, is suitable only for snow depths up to a few centimeters, and then in tandem with another snow clearing unit. The snow-sweeping roller ejects snow laterally, according to its slant position relative to the main vehicle under the condition that the roller has a certain, minimum rotational speed. Such a snow-sweeping roller can be affixed to the front or rear side of the road vehicle, or between its wheel axles. Known snow-sweeping rollers are subject to a high wear and energy consumption.

By contrast, the invention is based on equipping a snow-sweeping roller with a control device to make possible both low-wear operation and low energy consumption. The snow-sweeping roller of the invention is particularly suited for use in combination with a snow-clearing unit.

According to the invention, low-wear, low-energy snow-sweeping is achieved by using a control device which permits adjustment or modification of roller rotation in accordance with the following control factors;

(a) THe circumferential speed (w) of the roller is adjsuted according to vehicle speed (f);

(b) The circumferential speed (w) of the roller can be set in the range to twice the vehicle speed (f); and (c) The minimum circumferential speed of the roller (w-min) can be set to a value which will not be reduced even if the vehicle runs slowly or is stationary.

Control factor (a) causes the rotational speed of the roller to increase or decrease with the speed of the utility vehicle. This takes into account the quantity of snow as a function of vehicle speed. This is supplemented by the important condition of control factor (b), according to which the circumferential speed of the roller is equal or larger than the vehicle speed. Circumferential speed can be set to twice vehicle speed—either in discrete or continuously variable steps. For example, with snow levels to 1 cm, a ratio of 1.2 may be sufficient. At higher snow levels, e.g. 4 cm, the ratio of the circumferential roller speed to that of the vehicle may rise to 2.0.

A certain minimum throw width can be achieved, independently of a particular vehicle speed, for example, when the vehicle is stationary or is delayed before a traffic light. Snow is swept laterally from the area next to the vehicle. This is achieved in accordance with control factor (c), by setting a minimum value for the circumferential speed of the roller (w-min). The minimum speed should be set at about 5 km/hour. Even though the achievable throw widths are comparatively short, approximately on the order of 1 to 2 meters, the desired sweeping is accomplished. The roller encounters each patch of snow several times, until it is ejected from the vehicle.

Accordingly, the snow residue which always remains behind a snow plow, for example, can be swept away cleanly from the road surface. In addition to an improved cleaning effect, there also is the additional advantage that less salt must then be used in order to keep the road surface free from icing.

The control equipment is suitably constrained within the framework of the invention. Input data include the rates of roller circumferential speed and vehicle speed, the minimum circumferential speed of the roller, roller diameter, and vehicle speed. The ratio of roller circumferential speed to vehicle speed is essentially a function of snow level. The minimum circumferential speed of the roller (w-min) is generally independent of the sweeping application. In some circumstances, the minimum circumferential speed may depend on the length of the roller. The roller diameter is determined as precisely as possible, taking into account the wear on the bristles. While the input data can be entered by manual setting, vehicle speed is converted into a corresponding input signal, by, for example, a tachometer generator.

The sweeping action tends towards zero when the vehicle speed approaches the maximum circumferential speed of the roller. To warn the driver of the utility vehicle that this situation is being reached, the control equipment generates a warning signal when the maximum circumferential speed of the roller (w-max) has been reached, after going beyond an upper vehicle speed (f-max).

A value of maximum circumferential speed of the roller, obtained from practical driving operation, is about 30 km/hour. This value depends on the maximum power of the roller drive. With hydraulic drive it depends on the maximum rate of flow in the hydraulic system. If the driver hears a warning signal, he reacts by reducing vehicle speed. This assures not only that the circumferential speed of the roller always remains larger than vehicle speed, but also that the ratio of the two speeds is preserved in the established relationship.

In a preferred embodiment of the control device, an electronics system provides an output signal that activates a flow control valve in the pressure control line of a hydraulic roller drive. A regulatable or constant hydraulic pump is used. With a regulatable hydraulic pump, oil flow is adjusted so that a constant pressure difference is always maintained between the pressure side of the hydraulic pump and the load side. With a constant pump, oil flow remains unchanged during load pressure fluctuations. The partial flow that is not used by the load is returned, against load pressure, to the tank.

Power take-off for the hydraulic pump is effected either through an ancillary take-off from the transmission or through an engine powertake-off shaft.

DESCRIPTION OF THE DRAWINGS

An embodiment of the invention will be illustrated below in conjunction with the drawings, in which.

DETAILED DESCRIPTION

Figure 1:
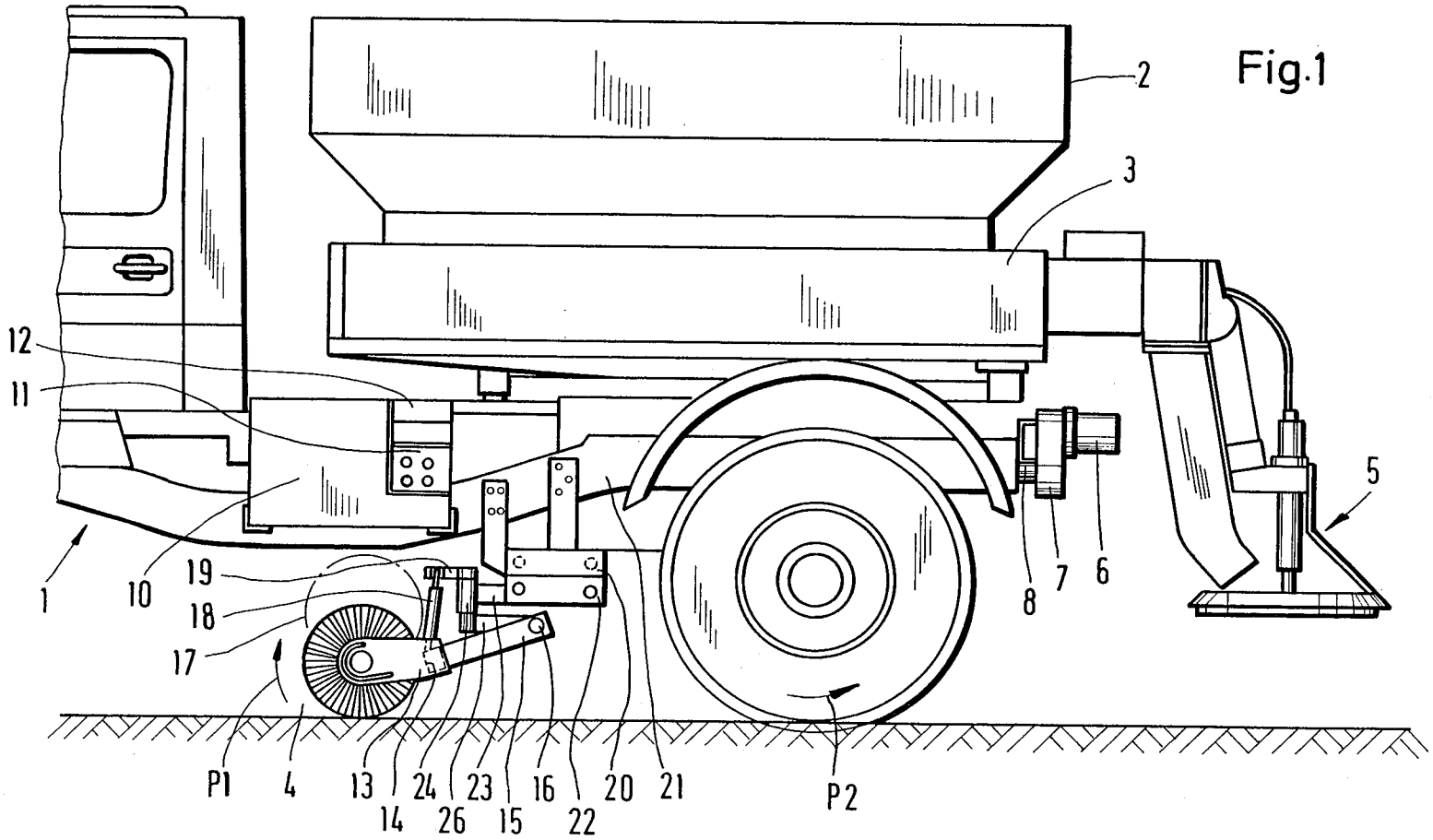
FIG. 1 is a side view of a snow-sweepung roller installed between the axles of a utility road vehicle.

FIG. 1 shows a utility road vehicle 1 with a spray-salt container 2 on a loading platform 3. The front axle of the vehicle 1 is not shown. A snow plow can be installed at the front of the vehicle. Snow residue that is not removed by the snow plow is ejected sidewardly from the vehicle by a snow roller 4 that is affixed between wheel axles on the underside of the vehicle. A salt spraying unit 5 is connected to the rear of the vehicle 1 to provide an ice-free, non-skidding road surface.

The snow-sweeping roller 4 rotates in clockwise sense according to arrow P1 in the drawing. Thus its rotation is opposite to the rotation according to arrow P2 of the vehicle wheels when the vehicle 1 moves forwardly.

The snow-sweeping roller is driven by a hydraulic pump 6 which is flanged to a rear transmission 7. On the drive side, the transmission is connected with an engine power take-off shaft 8. Hydraulic lines and other elements for hydraulic flow are not shown in the drawing, with the exception of the hydraulic motor 9 (FIG. 2) for driving the snow sweeping motor 4 and the hydraulic tank 10 affixed at the underside of the vehicle. These are shown as on structural unit, with an associated flow regulation valve 11 and control electronics 12.

Figure 3:
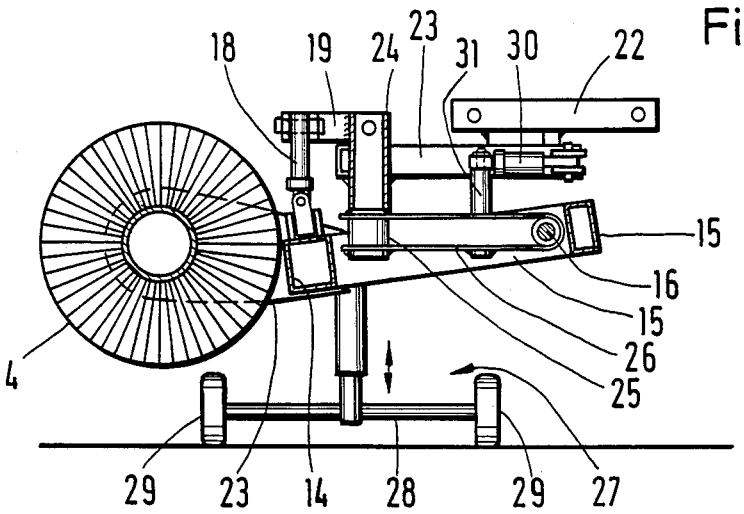
FIG. 3 is an enlarged representation, in vertical-longitudinal section, of a snow-sweeping roller that has been removed from the vehicle with its associated suspension.

The snow roller 4 is rotatably mounted in a frame with lateral flange parts 13 connected by a transverse spar 14. A U-yoke 15 of box profile is welded on the transverse spar 14. This is pivotably mounted about a horizontal axis 16 for raising or lowering the sweeping roller 4. In FIG. 3, the sweeping roller 4 is shown in its raised position, which corresponds to the dash and dot line 17 in FIG. 1. A hydraulic cylinder 18 is used to raise or lower the sweeping roller, which is hinged in the transverse spar 14 and at a support arm 19 of suspension device on the vehicle. The suspension device includes consoles 20 fixed in the vehicle, and flanged to the opposite longitudinal frame supports 21 of the vehicle 1. Holding struts 23 for a bearing part 24 are fastened by flanges 22 on the console 20. A lifting cylinder 18 is hinged on a support arm 19, which is rigidly connected with the upper end of a bearing 24, and is also hingably connected with the transverse spar 14. A pivot journal 25 with a vertical axis of rotation is formed at the lower end of the bearing part 24. A holding part 26 is pivotably mounted on the pivot journal 25. The U-yoke 15 is again pivotably suspended on the journal about the horizontal axis 16. Instead of a single hydraulic cylinder 18, a pair of cylinders can also be provided.

Figure 2:
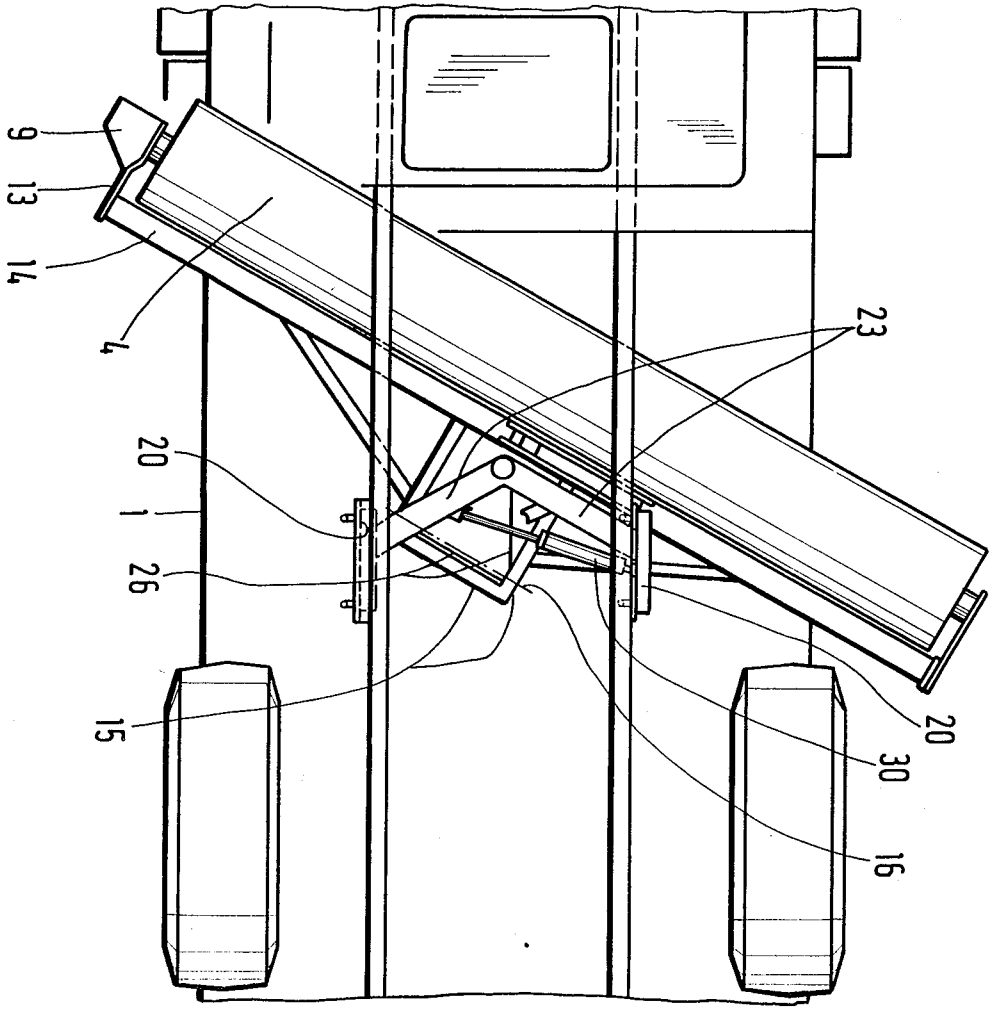
FIG. 2 is a top view of the snow-sweeping roller of FIG. 1.

According to FIG. 2, the snow-sweeping roller 4 is shown in a top view on the vehicle 1. The essential vehicle outline in the right pivot position is shown, with the pivot cylinder 30 extended. The pivot cylinder 30 is hinged, at one end, at the right holding strut 23, and, at the other end, at a pin 31, which is rigidly connected with the holding part 26 (compare FIG. 3, discussed below).

FIG. 3 shows the road-sweeping roller 4, together with its suspension, in a disassembled state, mounted on a chassis 27 of adjustable height. Only one axle 28 of the chassis 27 with wheels 29 is shown, corresponding to the sectional representation of the suspension.

Figure 4:
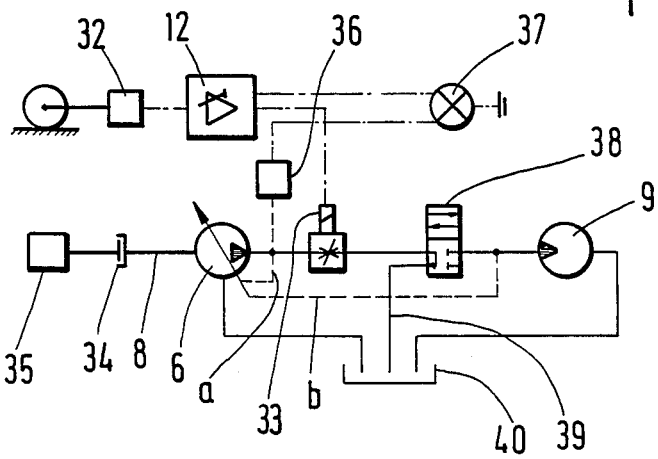
FIG. 4 is a hydraulic diagram for controlling the roller drive.

FIG. 4 shows a hydraulic diagram with a regulatable hydraulic pump 6 to drive the hydraulic motor 9 of the snow-sweeping roller 4. The driving speed (f) is determined through a tachometer generator 32. Its signal is amplified in the control electronics 12. The desired ratio of the roller circumferential speed to the vehicle speed, and the minimum circumferential speed of the roller, are entered into the control electronics. An output signal activates a proportionally activated flow control valve 33. This regulates oil flow on the pressure side of the hydraulic pump 6 in the manner of a diaphragm, and specifically in a fashion such that a constant pressure difference between the pressure side (a) of the hydraulic pump and the load pressure (b) is always maintained. The two pressure valuves (a and b) provide input signals for the pump control. The flow control valve 33, in practice, is integrated into the control system of the hydraulic pump. The hydraulic pump 6 is driven through a power take-off shaft 8 and a clutch 34 to the vehicle motor 35.

If the setting pressure of the pressure-limiting valve is indicated by the load pressure (b), a warning signal (at 37) is triggered through a pressure swutch 36. This indicates that the maximum fluid flow of the hydraulic system, and thus the maximum circumferential speed of the roller, has been reached. If the vehicle speed rises further, the proportionality between the roller circumferential speed and the vehicle speed, in the control electronics, can no longer be maintained.

A switch-on valve 38 is shown in its "off" position. Here, the hydraulic pump returns or conveys fluid into the supply tank 40, by way of a short-circuit line 39.

Figure 5:
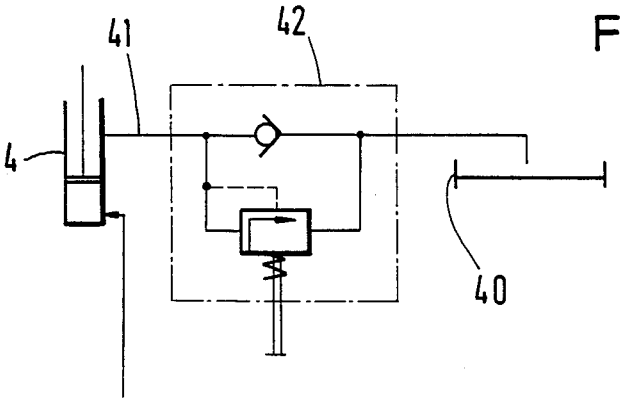
FIG. 5 is a hydraulic diagram for setting the roller pressure.

FIG. 5 shows a hydraulic diagram for regulating the contact pressure of the sweeping roller 4. To reduce wear on the bristles, it is advantageous to make the contact pressure adjustable. The result is that the roller contacts the ground either with its own inherent weight or, depending on the setting, with a lower weight. Relief is suitably accomplished hydraulically through the existing lifting cylinder (s). According to FIG. 5, this can be done by hydraulically preloading the return line 41 from the lifting cylinder 4 to the tank 40, where a pressure limiting valve 42 is connected into the return line 41.

Figure 6:
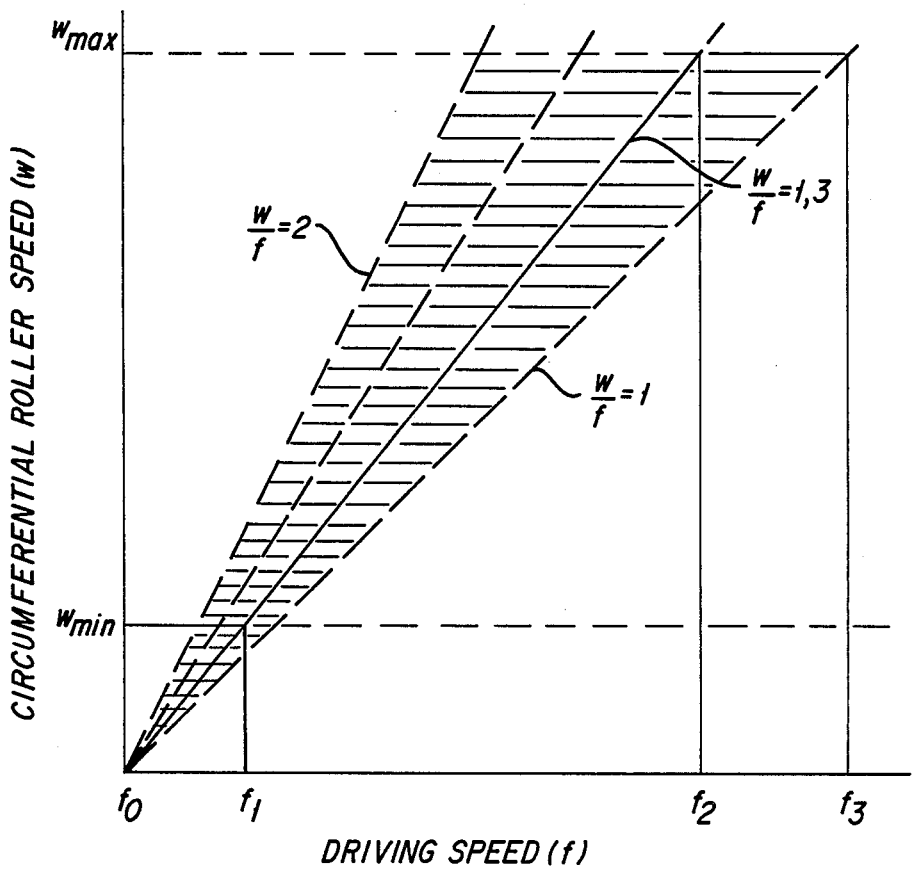
FIG. 6 is a graph illustrating the speed regulation characteristic for a snow-sweeping roller in accordance with the invention.

The graph of FIG. 6 illustrates the speed regulation characteristic of a snow-sweeping roller according to the invention. Various speed ratios w/f are specified between boundary positions 1 and 2. A selectable minimum circumferential speed of the roller (w-min) can be set so that the working proportionality between roller and vehicle speeds only begins at a vehicle speed $f_1$, and ends when a maximum circumferential speed $f_0$ the roller (w-max) is reached at a vehicle speed $f_2$. The solid line of the graph designates a speed ratio (w/f) of 1.3. Corresponding to this example, the minimum circumferential speed of the roller (w-min) is maintained from vehicle speeds $f_0$ through $f_1$. If the vehicle speed increases from $f_1$ to $f_2$, the relation that applies is $w=1.3\times f$. At vehicle speed $f_2$, the power limit of the hydraulic system is reached at w-max. The control equipment then generates a warning signal so that the driver of the utility vehicle can reduce speed. If, on the other hand, the driving speed is increased, the circumferential speed of the roller remains constant at w-max. When the driving speed $f_3$ is reached, the boundary ratio of w/f=1 is reached. Beyond this position, a noticeable sweeping effect can no longer be attained.

The set proportion of the ratio w/f should be preserved as the bristles of the snow-sweeping roller become worn. For this purpose, the diameter of the working roller is entered into the control electronics, i.e. when determining the roller rpm, the diameter ratio of a worn roller (diameter d) to a new roller (diameter D) is taken into account as a correction factor, e.g. according to the formula (a).

$$w=(D/d)\times d\times \pi\times n \qquad \text{(a)}$$

where "w" designates the roller circumferential speed and "n" designates roller rpm.

We claim:

1. A snow sweeping vehicle including wheels for locomotion and a detachable snow-sweeping roller, comprising means for suspending said roller about a settable slant axis relative to the direction of travel of said vehicle, first hydraulic means for raising and lowering said roller, second hydraulic means for adjusting said slant axis relative to said vehicle, means for rotating said roller in a direction opposite the forward rotation of said wheels, and variable speed driving means including electronic control means operable to adjust the speed of the driving means responsive to the speed (f) of said vehicle in a ratio range of about one to two, when moving, with the minimum speed of said roller occuring when said vehicle is stationary or slowly moving.

2. A snow-sweeping vehicle, according to claim 1, wherein the roller diameter (d) can be selected according to roller size and/or roller wear for determining the circumferential speed (w) of the roller.

3. A snow-sweeping vehicle, according to claim 1, wherein said control means generates a warning signal if an upper vehicle speed (f-max) is exceeded, indicating that the maximum circumferential speed (w-max) of the roller has been reached.

4. A snow-sweeping machine, according to claim 1, wherein said control means comprises a control circuit (12) for receiving input signals corresponding to the following:

(a) The ratio (w/f) of the circumferential speed (w) of the roller to vehicle speed (f);
(b) the minimum circumferential speed (w-min) of the roller;
(c) the roller diameter (d); and
(d) the prevailing vehicle speed (f).

5. A snow-sweeping machine, according to claim 2 wherein said control means comprises a control circuit (12) for receiving input signals corresponding to the following:

(a) the ratio (w/f) of the circumferential speed (w) of the roller to vehicle speed (f);
(b) the minimum circumferential speed (w-min) of the roller;
(c) the roller diameter (d); and
(d) the prevailing vehicle speed (f).

6. A snow-sweeping machine, according to claim 3 wherein the control means comprises a control circuit (12) with input signals corresponding to the following:

(a) the ration (w/f) of the circumferntial speed (w) of the roller to vehicle speed (f);
(b) the minimum circumferential speed (w-min) of the roller;
(c) the roller diameter (d); and
(d) the prevailing vehicle speed (f).

7. A snow-sweeping machine according to claim 4 including a proportional flow control valve, a hydraulic pump, and a hydraulic motor, wherein the output signal of the control circuit (12) activates a proportional flow control valve (33) in the pressure line of a hydraulic pump (6) that is driven from the vehicle side to regulate the flow for a hydraulic motor (9) to drive the snow-sweeping roller (4).

8. A snow-sweeping machine according to claim 5 including a proportional flow control valve, a hydraulic pump, and a hydraulic motor, wherein the output signal of the control circuit (12) activates said proportional flow control valve (33) in the pressure line of said hydraulic pump (6) that is driven from the vehicle side to regulate the flow for said hydraulic motor (9) to drive the snow-sweeping roller (4).

9. A snow-sweeping machine according to claim 6 including a proportional flow control valve, a hydraulic pump, and a hydraulic motor, the output signal of the control circuit (12) activates said proportional flow control valve (33) in the pressure line of said hydraulic pump (6) that is driven from the vehicle side to regulate the flow for said hydraulic motor (9) to drive the snow-sweeping roller (4).

10. A snow-sweeping machine according to claim 1 including means to adjust the contact pressure of the sweeping roller to only a portion of its inherent weight.

11. A snow-sweeping machine according to claim 2 including means to adjust the contact pressure of the sweeping roller to only a portion of its inherent weight.

12. A snow-sweeping machine according to claim 3 including means to adjust the contact pressure of the sweeping roller to only a portion of its inherent weight.

13. A snow-sweeping machine according to claim 4 including means to adjust the contact pressure of the sweeping roller to only a portion of its inherent weight.

14. A snow-sweeping machine according to claim 5 including means to adjust the contact pressure of the sweeping roller to only a portion of its inherent weight.

15. A snow-sweeping machine according to claim 6 including means to adjust the contact pressure of the sweeping roller to only a portion of its inherent weight.

16. A snow-sweeping machine according to claim 7 including means to adjust the contact pressure of the sweeping roller to only a portion of its inherent weight.

17. A snow-sweeping machine according to claim 8 including means to adjust the contact pressure of the sweeping roller to only a portion of its inherent weight.

18. A snow-sweeping machine according to claim 9 including means to adjust the contact pressure of the sweeping roller to only a portion of its inherent weight.

19. A snow sweeping vehicle as defined in claim 1 wherein said first hydraulic means includes a frame with lateral flange parts connected by a transverse spar by means of welding a U-shaped yoke of box profile to a transverse spar which is pivotably mounted about a horizontal axis for raising or lowering said roller to a slant by use of a hydraulic cylinder hinged in the transverse spar.

* * * * *